United States Patent [19]

Sperr

[11] Patent Number: 4,614,062

[45] Date of Patent: Sep. 30, 1986

[54] METAL FRAME ASSEMBLY FOR WINDOWS OR DOORS

[75] Inventor: Karl Sperr, Chur, Switzerland

[73] Assignee: Swiss Aluminium Ltd., Chippis, Switzerland

[21] Appl. No.: 672,704

[22] Filed: Nov. 19, 1984

[30] Foreign Application Priority Data

Nov. 30, 1983 [CH] Switzerland ..... 6387/83

[51] Int. Cl.[4] ..... E06B 1/04; E05D 7/00

[52] U.S. Cl. ..... 49/504; 49/401; 49/DIG. 1; 52/403

[58] Field of Search ..... 49/401, DIG. 1, 400, 49/504, 501; 52/402, 403

[56] References Cited

U.S. PATENT DOCUMENTS

| | | | |
|---|---|---|---|
| 2,877,515 | 3/1959 | Haas | 52/402 X |
| 3,420,026 | 1/1969 | Nolan | 49/DIG. 1 X |
| 3,430,384 | 3/1969 | Malenfant | 49/400 X |
| 4,115,972 | 9/1978 | Varlonga | 49/504 X |
| 4,344,254 | 8/1982 | Varlonga | 49/401 |

*Primary Examiner*—Philip C. Kannan

*Attorney, Agent, or Firm*—Bachman & LaPointe

[57] ABSTRACT

A metal frame assembly for windows or doors, comprising at least two sections that are joined together via an insulating strip, wherein the insulating strip is provided with a channel to accommodate a seal.

9 Claims, 3 Drawing Figures

METAL FRAME ASSEMBLY FOR WINDOWS OR DOORS

BACKGROUND OF THE INVENTION

The present invention relates to a metal frame assembly for windows or doors comprising at least two sections which are connected via a strip of insulating material.

Such metal frame asemblies are known for example from the Swiss patent publication No. 584 338. Described there is a connecting section for window frames in which the fixed frame is made up of two sections connected by a strip of insulating material. This insulating strip, viewed in cross section, comprises a wedge-shaped block against the peak of which a section for sealing the casement presses when the window is closed. These block-like insulating strips suffer the disadvantage that they have to be incorporated in the frame before installation of the window and even before the window is delivered to the building site or the like. Furthermore they can perform no other function than preventing thermal bridging in the frame.

SUMMARY OF THE INVENTION

The object of the present invention is to make the insulating strip much easier to use. In addition, it should be designed in such a way that it can also perform other functions within the frame assembly.

The foregoing object is achieved by way of the present invention wherein the insulating strip features a channel to accommodate a seal.

Usually the seals in metal frame assemblies are inserted in grooves in the metal frame sections. This can result, if the metal edges are not properly deburred, in the elastic sealing strips being damaged, which is prevented by the use of the plastic insulating strips. Furthermore, it is much more expensive and labor intensive to provide metal frame assemblies with the necessary channels than to incorporate these in the plastic of the insulating strip. In particular with increasing distance between metal sections the central seals in the sections of the frame do not have to be increased accordingly but instead can be mounted in the insulating strip or exchanged. Here too it is possible to achieve a more effective design of the central sealing means, especially in the region of the glazing, as is described below in accordance with the invention.

The channel is preferably formed by two inclined clamping strips which project out from the insulating strip and engage on a hammer-head-shaped projection on the sealing means. The seal as such can be of any material of choice. Preferred, however, are rubber-like seals.

In all an insulating strip should be made such that the clamping strips partly project over a strut which has heads, preferably wedge-shaped, at each side. With these heads the insulating strip engages in likewise undercut grooves in the sections that are to be joined together. This ensures that the insulating strip is securely held in place. The heads can additionally feature a longitudinal groove by means of which inaccuracy of fit in the groove is compensated.

A further possibility in the design of the insulating strips is for the strut of the insulating strip to feature at both sides an upper and lower lip which together form a mouth-shaped opening. In service this opening accepts a tongue on the sections to be joined which, if desired, features teeth that correspond to teeth in the mouth-shaped opening. As a result the anchoring of the insulating strips in the frame sections is improved.

A further improvement of the joining of the sections of the frame is achieved by providing pairs of insulating strip which are installed together in a mirror-image fashion. As such the channels for sealing means point outwards and can be fitted with a seal as required.

With insulating strips of such a design great flexibility in the construction of such assemblies is achieved, with the particular advantage that various frame sections can be joined together, according to the requirements. For this reason one requires a smaller number of different frame sections, which as a whole makes the manufacture of metal frame assemblies less expensive. Thus, it is also possible with the use of these insulating strips to join sections for frames of fixed windows or windows with casements or frames for doors.

A particularly advangtageous version according to the invention can be achieved for example with a glazed window or door if a channel in an insulating strip is made to accommodate a rubber seal with a hammer-head-shaped projection on the latter. The glazing rests on this rubber seal which in service forms a bend round the glazing and has a lip at one end pressed against the glass by a supporting metal section of the frame. This means that, either with fixed windows with only one casement or with openable windows or doors with one casement and one fixed frame, the fixed frame or casement is made up of at least three sections. Apart from an outer and an inner section fixed windows have in addition a holding or supporting section which makes a snap-fit connection with the inner section. In this case the fixed frame, made up of inner and outer sections, is mounted in the brickwork of the window space, the glazing then installed and the sealing lip laid around the inner pane of glass and pressed against the same by the holding or supporting section. This permits compensation of certain inaccuracies which arise during the building phase. On the other hand in the case of a window or door with a fixed frame and opening casement, the fixed frame comprises an outer and inner section and the casement an outer section and a contacting section, each section being joined to its partner section via insulating strips and the holding or support section, after insertion of the loop-like window seal and the glazing, making a snap-fit connection with the outer section. Sealing the glazing this way produces a very effective barrier to moisture.

Furthermore according to the invention in the case of a window or door comprising a fixed frame and a casement additional, facing, sealing elements should be provided for both parts of the frame. To this end a sealing lip is mounted in the insulating strips joining the sections of the casement. When the window or door is closed, this lip rests against a nose on a rubber section which is mounted in a channel in one of the insulating strips joining together the sections of the fixed frame.

The invention is, however, not limited to the exemplified embodiments described here, but can be applied in further versions of windows and doors, for example tilting windows or sliding doors. In all a very extensive range of design possibilities is made available to the designer with the benefit of simplification of window manufacture.

BRIEF DESCRIPTION OF THE DRAWINGS

Further advantages, features and details of the invention are revealed in the following description of a preferred exemplified embodiment and with the help of the drawings wherein.

DETAILED DESCRIPTION

Figure 1:
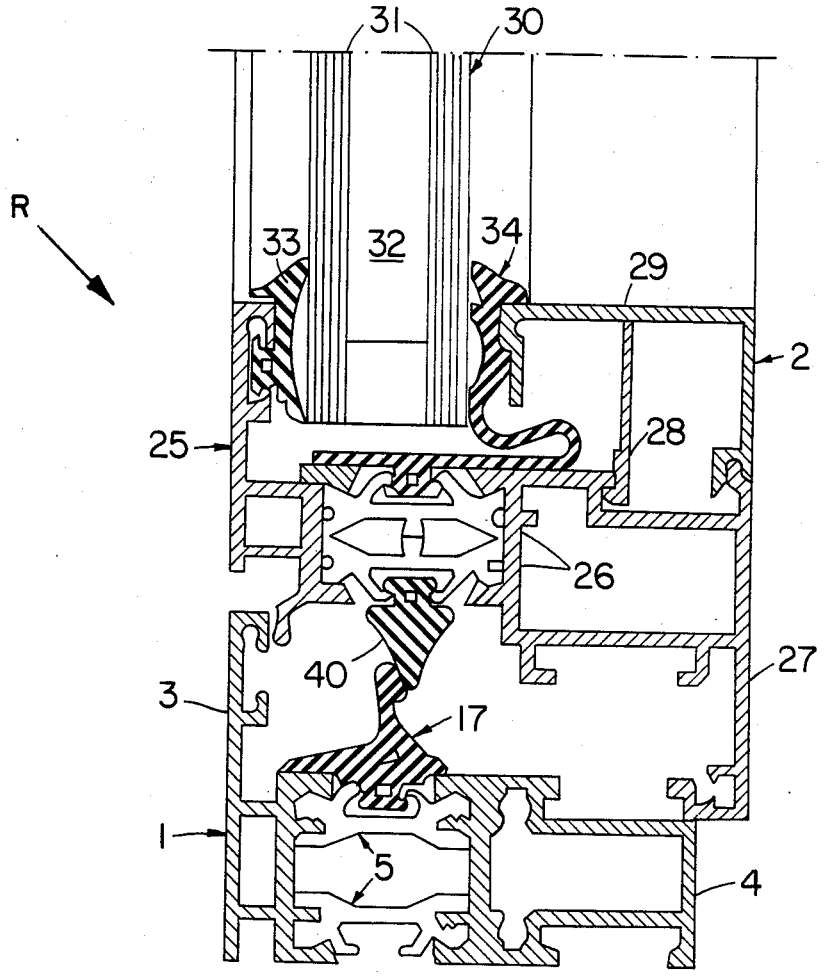
FIG. 1: A cross section through a metal frame assembly partly showing the glazing thereof.

A metal frame assembly R for windows or doors having glazing without putty or the like comprises according to FIG. 1 a built-in frame 1 and a casement 2 which can swing on hinges, not shown here, while frame 1 is fixed stationary in a wall brickwork or the like. As such frame 1 is made up of an outer section 3 and inner section 4. Both sections 3 and 4 are joined together via profiled insulating strips 5 to prevent thermal bridging.

Figure 2:
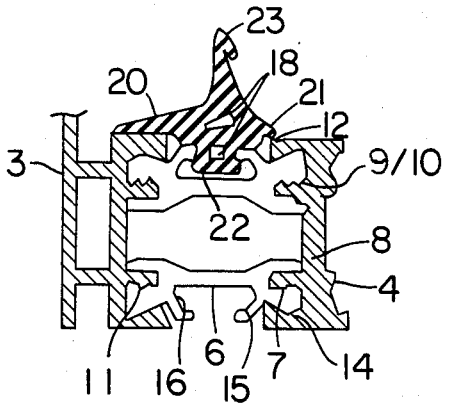
FIG. 2: A detail from FIG. 1.

An insulating strip 5 shown in FIG. 2 features strut 6 with, at both ends, upper and lower lips 7 and 8 respectively which form a mouth-shaped opening 9 between them. Engaging in this opening 9 are tongues 10 projecting out from sections 3 and 4, the said tongues 10 featuring teeth 11. Together with a strip 12 projecting out from sections 3 and 4 the tongue 10 forms an undercut groove 14 in which upper lip 7 is securely held. Projecting out from the upper lip 7, partially over strut 6 are two claw-like clamping strips 15 which are inclined towards each other and form between them an undercut channel 16 into which a rubber section 17 is inserted. That section 17 features two compensating chambers 18 and contact strips 20 and 21 with which it braces itself against strips 12 of sections 3 and 4. On the side remote from the hammer-shaped head 22 engaging in channel 16 the rubber section 17 is in the form of a raised nose 23.

The casement 2 in the exemplified embodiment shown in FIG. 1 comprises an outer section 25 which again is connected to an adjoining section 27 by an insulating strip 26. Between the outer section 25 and a counterlying section 29 mounted on section 27 via snap-fit connection 28 is the glazing 30 comprising two panes of glass 31 with a space 32 between them which can be evacuated, the glazing 30 being supported by rubber sections 33 and 34.

Figure 3:
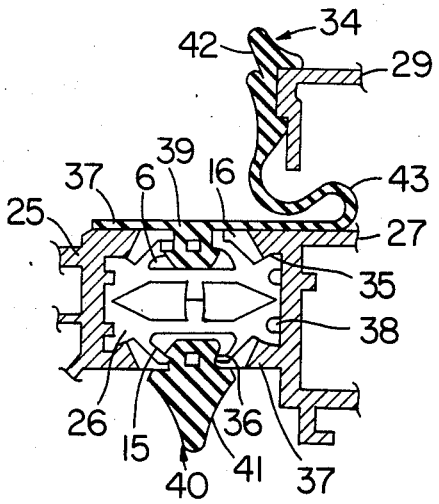
FIG. 3: A further detail from FIG. 1.

As shown in more detail in FIG. 3 the outer section 25 and section 27 are joined via two insulating strips 26 the heads 35 of which touch and are held apart at approximately the centre by struts 36. Two heads 35 on one side are clamped by wedge-shaped strips 37. Inside the heads 35 is a channel 38 to accommodate sealing and adhesive material and to compensate for inaccuracy when fitting the parts together. Each of the two heads on section 26 is joined by a strut 6 which, as with insulating strip 5, features clamping strips 15 that feature a channel 16 to accommodate a hammer-head-like projection 39 on the rubber seal 34 and a hammer-head-like projection 41 on a sealing strip 40 which is wedge-shaped in cross section. When the metal frame assembly R is closed, the sealing strip 40 lies against the nose 23 on rubber section 17 (shown in FIG. 1).

Between the hammer-head-shaped projection 39 and a seal 42 pressing against the glazing 30 is a rubber seal 34 which is laid with a bend 43 over parts 37 or parts of the outer section 25 and over section 27, thus preventing any penetration of air or moisture into the supporting section 29 or to an inner lying space.

Such moisture proof glazing can according to the invention be installed in a simple manner from the inside as it is only after the installation of the fixed frame 1 and casement 2 with its outer section 25 and contact section 27 that the glazing 30 is placed on the rubber seal 34 and the sealing lip 42 pressed against the inner pane of glass 31 with the installation of the supporting section 29. It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An insulated metal frame assembly for windows and doors comprising at least two opposed metal sections which are joined together by an insulating strip provided with a strut and with a channel to receive a seal, said channel being formed by a pair of clamping strips projecting out from said strut of said insulating strip to form an undercut groove and said seal being provided with a hammer-head-shaped projection having a groove which receives the pair of clamping strips such that the hammer-head-shaped projection of said seal is received in said undercut groove, wherein each of said at least two opposed metal sections is provided with a pair of spaced apart wedge-shaped strips defining substantially U-shaped undercut grooves in each of said sections and said strut is provided with heads on its ends which are adapted to engage the wedge-shaped strips on said at least two opposed metal sections.

2. A metal frame assembly according to claim 1 wherein at least two insulating strips join together two sections.

3. A metal frame assembly according to claim 1 wherein the insulating strip features a strut which features at both sides an upper lip and a lower lip defining an opening therebetween which accommodates a tongue provided on the sections to be joined wherein said clamping strip partially projects over said strut.

4. A metal frame assembly according to claim 3 wherein the upper lip is additionally held in place by a wedge-shaped strip on the sections.

5. A metal frame assembly according to claim 3 wherein the tongue features teeth which engage on similar teeth in opening.

6. A metal frame assembly according to claim 1 wherein the channel in the insulating strip accommodates a rubber seal which has a hammer-head-like projection against which glazing rests and which forms a bend around the glazing and has its lip on the inner side of the window pressed against the glazing by a supporting section.

7. A metal frame assembly according to claim 6 for a stationary window with a fixed frame wherein the fixed frame comprises an outer section and an inner section both joined together via insulating strips and the inner section engages with a supporting section in a snap-fit manner.

8. A metal frame assembly according to claim 6 for a window or a door with a fixed frame and a casement frame wherein the fixed frame comprises an outer section and an inner section and the casement of an outer section and a contact section, and the corresponding sections are joined together via insulating strips, the supporting section engaging with a snap-fit connection with outer section.

9. A metal frame assembly according to claim 8 wherein on the opposite side from seal in another insulating strip a sealing lip is provided which, when the window or door is closed, presses against a nose on a rubber section which is mounted in a channel in an insulating strip which joins together the inner section and the outer section.

* * * * *